US009668074B2

(12) United States Patent
Drullinger et al.

(10) Patent No.: US 9,668,074 B2
(45) Date of Patent: May 30, 2017

(54) ISOLATION, EXTRACTION AND EVALUATION OF TRANSIENT DISTORTIONS FROM A COMPOSITE SIGNAL

(71) Applicant: LitePoint Corporation, Sunnyvale, CA (US)

(72) Inventors: Todd Drullinger, Redwood City, CA (US); Michael Smedegaard, San Jose, CA (US); Rick Chao, San Jose, CA (US); Soren Louis Pedersen, Copenhagen (DK)

(73) Assignee: LitePoint Corporation, Sunnyvale, CA (US)

( * ) Notice: Subject to any disclaimer, the term of this patent is extended or adjusted under 35 U.S.C. 154(b) by 190 days.

(21) Appl. No.: 14/450,071

(22) Filed: Aug. 1, 2014

(65) Prior Publication Data

US 2016/0037275 A1 Feb. 4, 2016

(51) Int. Cl.
*H04R 29/00* (2006.01)

(52) U.S. Cl.
CPC ..... *H04R 29/001* (2013.01); *H04R 29/00* (2013.01)

(58) Field of Classification Search
None
See application file for complete search history.

(56) References Cited

U.S. PATENT DOCUMENTS 7,778,315 B2 * 8/2010 Ferguson ..... H04B 17/345 375/224
2008/0037804 A1 * 2/2008 Shmunk ..... H04R 3/04 381/96
2010/0331715 A1 12/2010 Addison et al.
2012/0051549 A1 3/2012 Nagel et al.
2012/0200284 A1 8/2012 Dionne
2013/0195277 A1 * 8/2013 Kannan ..... H04R 1/32 381/56

(Continued)

FOREIGN PATENT DOCUMENTS

JP 2010-057016 3/2010
WO WO 02/25997 A1 * 3/2002

OTHER PUBLICATIONS

Davy, Manuel, and Christian Doncarli. "A New Nonstationary Test Procedure for Improved Loudspeaker Fault Detection." J. Audio Eng. Soc. 50.6 (2002): 458-69.*

(Continued)

*Primary Examiner* — Joseph Saunders, Jr.
*Assistant Examiner* — James Mooney
(74) *Attorney, Agent, or Firm* — Choate, Hall & Stewart LLP; Paul Pysher

(57) ABSTRACT

A method for processing a time-domain signal with transient oscillations includes: performing, by one or more computer systems, a time-frequency representation transform on the time-domain signal to obtain a plurality of coefficients for, with a coefficient corresponding to a presence of an impulse response of a filter used by the time-frequency representation transform; selecting one or more of the coefficients, with the selected one or more of the coefficients having attributes that are more indicative of the transient oscillations; and reconstructing, based on performing an inverse transform on the selected one or more coefficients, a portion of the time-domain signal that represents the transient oscillations.

39 Claims, 5 Drawing Sheets

(56) References Cited

U.S. PATENT DOCUMENTS

2013/0268264 A1 10/2013 Taleb et al.
2015/0046156 A1* 2/2015 Coifman ..... G10L 21/0208
704/226

OTHER PUBLICATIONS

International Search Report and Written Opinion mailed Nov. 11, 2015 in PCT application No. PCT/US2015/041803, 12 pgs.

* cited by examiner

ISOLATION, EXTRACTION AND EVALUATION OF TRANSIENT DISTORTIONS FROM A COMPOSITE SIGNAL

BACKGROUND

Transient distortion is a particular type of sound distortion that typically originates in mechanical faults in a device. For loudspeakers, this kind of distortion is called rub and buzz.

SUMMARY

In one aspect, a method for processing a time-domain signal with transient oscillations: performing, by one or more computer systems, a time-frequency representation transform on the time-domain signal to obtain a plurality of coefficients for, with a coefficient corresponding to a presence of an impulse response of a filter used by the time-frequency representation transform; selecting one or more of the coefficients, with the selected one or more of the coefficients having attributes that are more indicative of the transient oscillations; and reconstructing, based on performing an inverse transform on the selected one or more coefficients, a portion of the time-domain signal that represents the transient oscillations. A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

The foregoing and other embodiments can each optionally include one or more of the following features, alone or in combination. In particular, one embodiment may include all the following features in combination. The attributes of the selected one or more coefficients represent a similarity of the model transient waveform to the transient oscillations in the time-domain signal. The time-frequency representation transform is a discrete wavelet transform. The transient oscillations are associated with coefficients with frequency bands above a threshold frequency band, and wherein the method further comprises: removing one or more of the obtained coefficients with one or more frequency bands below the threshold frequency band to remove coefficients that are unassociated with the transient oscillations; wherein selecting comprises selecting from remaining ones of the obtained coefficients. The actions include performing segmentation in time on the remaining ones of the coefficients, with segmentation in time for a coefficient dividing the coefficient into one or more portions indicative of a characteristic of the coefficient. The segmentation is a Kurtosis-based segmentation that is based on one or more sliding Kurtosis windows in time, and wherein the method further comprises: for a remaining coefficient, determining a maximum Kurtosis value of a Kurtosis-based segmentation for the remaining coefficient; for maximum Kurtosis values of the remaining coefficients, determining a ratio of (i) a highest maximum Kurtosis value, to (ii) a lowest maximum Kurtosis value; wherein selecting comprises selecting the coefficient, when the maximum coefficient value exceeds a maximum coefficient threshold and the ratio exceeds a ratio threshold. The segmentation is a Kurtosis-based segmentation that is based on one or more sliding Kurtosis windows, and wherein the method further comprises: correlating a resulting Kurtosis sliding window result against an expected model result for a particular stimulus frequency; wherein the selected one or more coefficients are based on correlations among the Kurtosis sliding window results and expected models.

In another aspect, a method for detecting transient oscillations in a response signal from a device under test includes performing a transform on the response signal; reconstructing, by one or more computer systems, a time-domain signal that represents the transient oscillations, with reconstruction based on the transform; executing a time-varying psychoacoustic model, with the reconstructed time-domain signal being an input to the time-varying psychoacoustic model; obtaining, based on executing, a value indicative of an attribute for at least a portion of the transient oscillations; comparing the obtained value to a threshold value; and determining, based on comparing, a pass state or a fail state for the device under test. A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

The foregoing and other embodiments can each optionally include one or more of the following features, alone or in combination. In particular, one embodiment may include all the following features in combination. In one example, the device under test is an acoustic transducer, and wherein the transient oscillations are indicative of rub and buzz distortions in the acoustic transducer, wherein a rub and buzz distortion comprises a non-linear sound distortion. The actions include identifying a relative time location in the reconstructed time-domain signal in which specified features occur, based on a cycle-by-cycle analysis of the reconstructed time-domain signal, with respect cycles of an original stimulus waveform. The specified features comprise the transient oscillations or modulated noise. The transform provides a time-frequency representation of the time-domain signal.

In this aspect, a stimulus is transmitted to the device under test in a plurality of stimulus cycles, wherein the transform provides a time-frequency representation of the time-domain signal, and wherein reconstructing comprises: reconstructing, in the time-domain for the plurality of stimulus cycles, the time-domain signal, with reconstructing based on the time-frequency representation; wherein the reconstructed time-domain signal comprises portions, with each portion associated with one of the stimulus cycles; and wherein the method further comprises: for a particular stimulus cycle, identifying a time location, relative to the particular stimulus cycle, of features included in a portion of the reconstructed time-domain signal by identifying a location in time of the features included in the portion of the reconstructed time-domain signal that is associated with the particular stimulus cycle; and determining a failure type of the device under test based on time locations, relative to the stimulus cycles, of the features in the reconstructed time-domain signal.

In this aspect, the time locations, relative to the stimulus cycles, of the features are substantially the same among the stimulus cycles, and wherein the failure type comprises one or more of: voice coil rubbing resulting only from a misaligned voice coil in the device under test; voice coil bottoming in the device under test; and an air leak in the device under test. The time locations, relative to the stimulus cycles, of the features vary among the stimulus cycles of different frequencies, and wherein the failure type comprises one or more of: voice coil wire buzzing in the device under test; and voice coil rubbing resulting from uneven cone mass distribution in the device under test. The time locations, relative to the stimulus cycles, of the features vary among the stimulus cycles of same and different frequencies and for different applications of the same stimulus frequency, and wherein the failure type comprises: audio distortions from a trapped foreign object in the device under test. The actions include removing noise from the reconstructed time-domain signal, prior to executing the time-varying psychoacoustic model, to promote the obtained value being based primarily on the transient oscillations and not based on noise.

The actions include measuring a magnitude and a phase of a voltage across and a current into the device under test, when a stimulus signal is fed to the device under test; estimating a voice coil temperature in real time, at least partly based on the voltage across the device under test, the current into the device under test, a metal type of a voice coil in the device under test, an effective mass of the voice coil in the device under test, an amount of thermal resistance of the voice coil in the device under test, an amount of inductance of the voice coil in the device under test, and an amount of direct current resistance in the voice coil in the device under test; determining, based on a measured sound pressure level in the device under test, a drop in sound pressure level relative to a sound pressure level in an absence of power compression; adjusting, based on the determined drop, a voltage of a stimulus signal fed to the device under test to compensate for the power compression; and performing post-processing compensation of the measured sound pressure level for power compression in the device under test, based on at least one of the voice coil temperature the current into the device under test or the voltage across the device under test.

In this aspect, the device under test is an acoustic transducer. The acoustic transducer comprises one of a device that is acoustic signal in and electrical signal out, a device that is electrical signal in and acoustic signal out, a microphone or a loudspeaker. The actions include calculating speaker impedance of the device under test as a function of frequency, based on the measured current and voltage; determining, based on calculating the speaker impedance, a resonance frequency of the device under test; generating, based on the resonance frequency, the stimulus signal to have a frequency at the resonance frequency. The time-varying psychoacoustic model comprises a time-varying loudness psychoacoustic model, and the attribute is loudness; the time-varying psychoacoustic model comprises a time-varying timbre psychoacoustic model, and the attribute is timbre; the time-varying psychoacoustic model comprises a time-varying pitch psychoacoustic model, and the attribute is pitch; the time-varying psychoacoustic model comprises a time-varying psychoacoustic model for determining a quantitative measure, and the attribute is the quantitative measure; or the time-varying psychoacoustic model comprises a time-varying psychoacoustic model for determining a qualitative measure, and the attribute is the qualitative measure.

In another aspect, a method for performing analytical analysis on detected distortion features in a response signal from a device under test include performing a transform on the response signal; reconstructing, by one or more computer systems, a time-domain signal that represents the distortion features, with reconstruction based on the transform; and performing an analytical operation using one or more values included in the reconstructed time-domain signal. A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

In this aspect, the analytical operation comprises one or more of: a root mean square (RMS) operation to determine a RMS value of at least a portion of the reconstructed time-domain signal; an operation to determine a peak value of at least a portion of the reconstructed time-domain signal; an operation to determine a crest factor of at least a portion of the reconstructed time-domain signal; an operation to determine a mean value of the reconstructed time-domain signal; an operation to determine a Fourier transform of the reconstructed time-domain signal; an operation to determine an energy value of at least a portion of the reconstructed time-domain signal; an operation to determine a power value of at least a portion of the reconstructed time-domain signal; an operation to determine a peak value of at least a portion of the reconstructed time-domain signal; an operation to determine a duration of at least a portion of the reconstructed time-domain signal; and an operation to perform envelope analysis of at least a portion of the reconstructed time-domain signal.

All or part of the foregoing can be implemented as a computer program product including instructions that are stored on one or more non-transitory machine-readable storage media (and/or one or more machine-readable hardware storage devices), and that are executable on one or more processing devices. All or part of the foregoing can be implemented as an apparatus, method, or electronic system that can include one or more processing devices and memory to store executable instructions to implement the stated functions.

The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

A system consistent with disclosure detects manufacturing defects (e.g., a rub and buzz defect) in various types of devices, e.g., acoustic transducers, automobiles, various types of electronic and mechanical devices, and so forth. There are various types of acoustic transducers (e.g., loudspeakers, microphones, micro-speakers that are used in smartphones and tablets, and so forth). Generally, a rub and buzz defect includes a non-linear sound distortion that is annoying to a listener. The system implements a test methodology and analysis technique to identify if rub and buzz is present, isolate a rub and buzz waveform (if present), assess the loudness of the distortion caused by the defect, and determine the specific type of device failure source responsible for the distortion. Many of the below-described techniques and examples are described with regard to rub and buzz defects. These techniques are also applicable to detect other types of distortions and defects.

Figure 1:
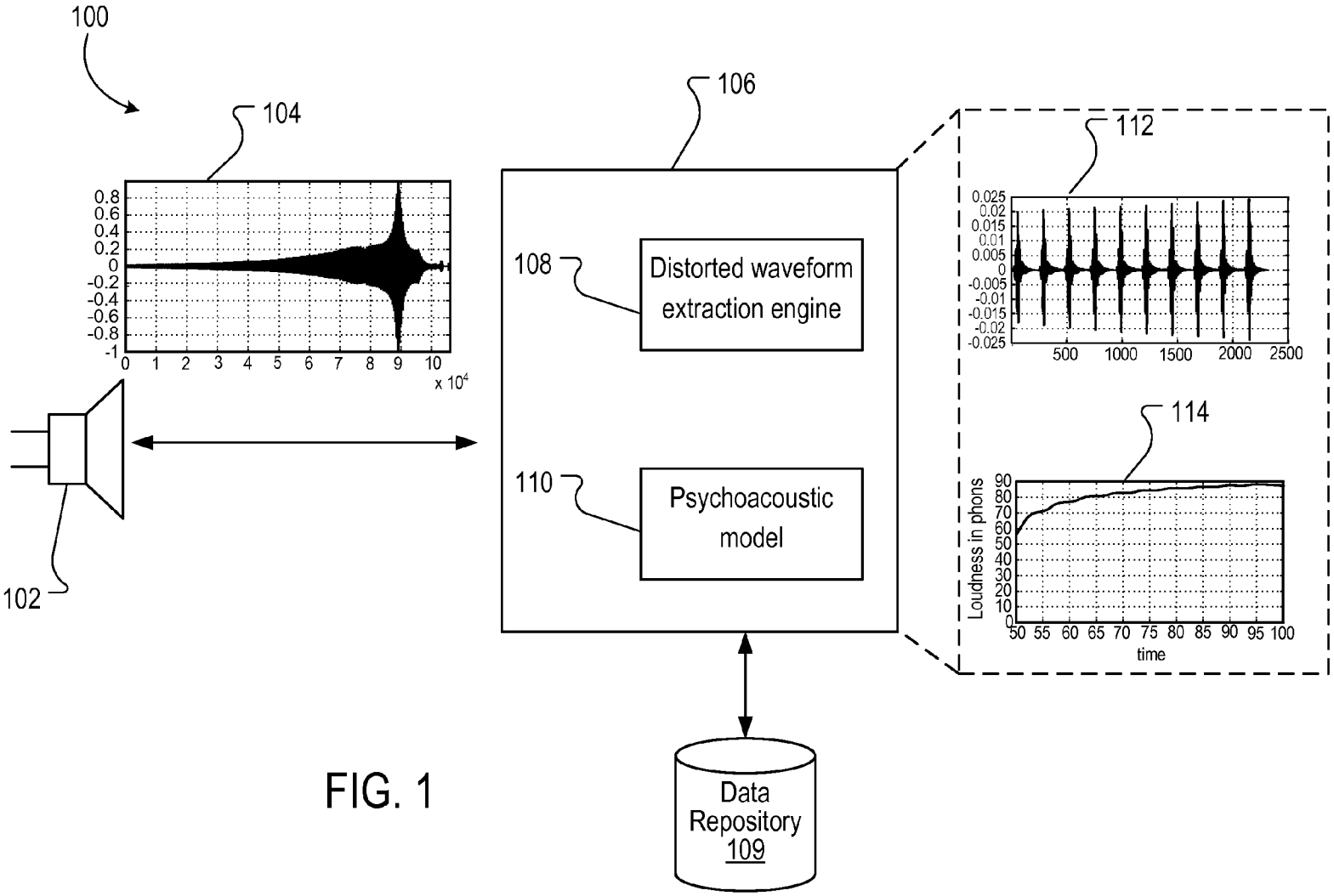
FIG. 1 is a diagram of an environment for testing transducers.

Referring to FIG. 1, test environment 100 includes device under test 102 (e.g., a speaker, a receiver, microphone, and so forth), system 106 (e.g., a test system) and data repository 109. System 106 generates a stimulus waveform (not shown) for the device under test 102. The stimulus waveform is generated to concentrate energy in frequency regions where the most severe distortions occur for defined types of faults (e.g., rub and buzz defects), and where the analysis can extract the distortion features with minimum interference from other types of distortion. The stimulus waveform includes a frequency sweep stimulus that concentrates energy around a resonant frequency of device under test 102, which allows system 106 to detect a worst-case distortion with a) decreased overall test time, and/or b) increased noise immunity from averaging the results of several short tests repeated back-to-back.

In response to the stimulus waveform, device under test 102 generates response 104 to the stimulus waveform. Response 104 is transmitted to system 106, which records response 104 with very high sensitivity/signal-to-noise ratio. System 106 records response 104 in data repository 109.

System 106 includes distorted waveform extraction (DWE) engine 108 to accurately extract only (or a portion of) distortion features of response 104. There are various types of distortion features, including, e.g., transient oscillations and modulated noise. DWE engine 108 uses a wavelet-based decomposition and reconstruction (e.g., analysis) technique to extract as accurately as possible most or all of the energy associated with a distortion oscillation. This wavelet-based decomposition uses orthogonal filters, rather than non-orthogonal filters in which some of the energy is lost (e.g., due to energy of the distortion features being spread out across a spectrum). Due to this lost energy, estimates of severity (of the distortions) may be inaccurate with the non-orthogonal filters. By using orthogonal filters, DWE engine 108 is able to separate the waveforms of interest from regular harmonics and from noise, e.g., thereby increasing the accuracy of the detected distortions.

DWE engine 108 selects wavelet transforms (e.g., filters) closely matched to defined distortions (e.g., distortions associated with rub and buzz defects). These selected wavelet transforms increase the signal to noise ratio of the distortions, relative to signal to noise ratios of other techniques (e.g., Fourier transforms). Generally, a transform uses a filter to remove from a signal some unwanted component or feature, while retaining others. In an example, the transform is a time-frequency representation transform that produces a time-frequency representation of the response.

In this example, data repository 109 includes a filter bank of various filters that may be used on response 104. DWE engine 108 selects, from data repository 109, one or more filters, based on a specific shape of an impulse response (in the time domain) of the filters. That is, DWE engine 108 selects a filter that has an impulse response matching specific types of damped oscillations that are associated with rub and buzz defects. By doing so, DWE engine 108 ensures that the portions of response 104 including the specified damped oscillations (e.g., the oscillations that the DWE engine 108 is looking for) are mapped to only a few impulse responses in the transform domain, thus making selection of impulse responses more effective, as described below. Additional details of extraction are described below.

DWE engine 108 performs one or more transforms (e.g., time-frequency representation transforms) on response 104 to obtain coefficients for response 104. A coefficient corresponds to a presence of an impulse response of a filter used by the time-frequency representation transform. The impulse response is represented by a model transient waveform. DWE engine 108 selects one or more of the coefficients, with the selected one or more of the coefficients having attributes that are more indicative of the transient oscillations. In an example, the attributes of the selected one or more coefficients represent a similarity of the model transient waveform to the transient oscillations in the time-domain signal (e.g., a composite signal). Based on performing an inverse transform on the selected one or more coefficients, DWE engine 108 reconstructs (e.g., extracts) waveform 112, which only includes distortion features of response 104.

System 106 accesses psychoacoustic model 110 and applies it to extracted waveform 112. There are various types of psychoacoustic models, e.g., a loudness psychoacoustic model, a timbre psychoacoustic model, a psychoacoustic model for determining a quantitative measure, a psychoacoustic model for determining a qualitative measure, and so forth. In the example of FIG. 1, psychoacoustic model 110 is a loudness psychoacoustic model to determine the psychoacoustic loudness of the extracted distortion waveform as it would be perceived by a human listener. Based on application of the model 110, system 106 determines loudness measurement 114, e.g., information indicative of the loudness of the rub and buzz defect over a period of time. A maximum loudness is a rub and buzz distortion measurement for device under test 102.

This loudness measurement allows the manufacturer (of the devices being tested) to set a loudness threshold above which devices are considered failed, or to categorize the quality of devices with respect to rub and buzz for sale at different price points. System 106 compares loudness measurement 114 to a user-configurable threshold. When one or more portions of loudness measurement 114 exceed the threshold, system 106 classifies device under test 102 as failing (e.g., as being in a failed state). When loudness measurement 114 is less than the threshold, system 106 classifies device under test 102 as passing (e.g., as being in a passed state).

System 106 also analyzes extracted waveform 112 to determine the type of device defect responsible for the distortion, e.g., by performing failure analysis that correlates distortion on a cycle-by-cycle basis that assists in identifying the source of the distortion. This failure analysis provides information about where the distortions occur (in time) relative to the displacement (physical position) of the transducer diaphragm, as described in further detail below.

The presence of rub and buzz-type oscillations can be masked to a human listener by the type of stimulus used (such as a sine or swept sine), but be clearly audible under different conditions (regular speech or music, for example). Using the techniques described herein, system 106 extracts the rub and buzz elements of the waveform and estimates the loudness, without regard to masking effects in order to ensure a 'worst-case-scenario' type of measurement.

In an example, system 106 measures current into the device under test 102 and uses the measured current to adaptively set the stimulus voltage level to promote maximum displacement of device under test 102 during testing. Displacement is generally proportional to current into device under test 102. Generally, by displacing device under test 102 (or a diaphragm within device under test 102) a maximum amount, the system ensures that device under test 102 is being effectively tested. Displacement in the diaphragm may cause sound distortion. So, by displacing device under test 102 (or a diaphragm within device under test 102) a maximum amount, system 106 is able to test for sound distortion. A diaphragm (generally, but not exclusively cone shaped) includes a thin, semi-rigid membrane attached to the voice coil, which moves in a magnetic gap, vibrating the diaphragm, and producing sound.

In particular, system 106 measures a magnitude and a phase of a voltage (as a function of frequency) across and a current (as a function of frequency) into the device under test 102, when a stimulus signal is fed to device under test 102. These measurements are performed periodically (e.g., continuously). Based on these current measurements, system 106 determines information about the root mean square (RMS) power dissipated in a voice coil (not shown) of device under test 102, as well as diaphragm displacement—due to an electromechanical force (which causes the displacement) in a speaker diaphragm (of device under test 102) being proportional to the current into the voice coil.

Using these measurements, system 106 adaptively sets the stimulus voltage level and performs power compression compensation. System 106 measures sound pressure level in device under test 102. As previously described, system 106 determines the amount of RMS power dissipated in the voice coil, which is caused by power compression. Based on the RMS, system 106 determines what the sound pressure level would have been without the power dissipation. System 106 determines a drop in sound pressure level. This drop is an amount of difference between the measured sound pressure level and what the sound pressure level would have been without the power dissipation.

To compensate for the sound pressure level drop, system 106 adjusts (e.g., increases) the stimulus voltage, which increases the current through device under test 102 to compensate for the sound pressure level drop. The voltage is increased up to a point at which the measured sound pressure level substantially equals a sound pressure level without power dissipation. This real-time compensation and adjustment of the stimulus voltage is based on the current through the voice coil in the device under test directly determining an electromechanical force on a speaker diaphragm of device under test 102.

For example, a maximum transducer displacement is needed to stimulate rub and buzz oscillations in a device under test. So if a given stimulus is resulting in lower than expected displacement because of the power compression/voice coil heat up phenomenon, system 106 increases the input voltage to get the same physical displacement of the transducer (that would occur in an absence of the power compression).

System 106 also performs post-processing compensation of the measured sound pressure level for power compression in device under test 102, based on at least one of the voice coil temperature the current into the device under test or the voltage across device under test 102. System 106 performs power compression compensation (e.g., both in real-time via adjustment of the voltage stimulus and in post-processing) on various types of devices under test, including, a device that is acoustic signal in and electrical signal out, a device that is electrical signal in and acoustic signal out, a microphone and a loudspeaker.

Based on these measurements of current and voltage, system 106 also estimates a voice coil temperature in real time, to ensure that a voice coil temperature resulting from compensation does not damage device under test 102 and is within a range of acceptable temperatures. This temperature estimation is also based on a metal type of a voice coil in the device under test, an effective mass of the voice coil in device under test 102, an amount of thermal resistance of the voice coil in device under test 102, an amount of inductance of the voice coil in device under test 102, and an amount of direct current resistance in the voice coil in device under test 102.

Based on these current and voltage measurements, system 106 also calculates speaker impedance of device under test 102 as a function of frequency. System 106 determines, based on calculating the speaker impedance, a resonance frequency of device under test 102. System 106 also generates, based on the resonance frequency, the stimulus signal to have a frequency at the resonance frequency, to promote maximum displacement of device under test 102 during testing. By doing so, system 106 provides maximum cone excursion for minimum electrical input.

System 106 also performs analytical analysis on detected distortion features (e.g., extracted waveform 112) of a response signal (e.g., response 104) from a device under test (e.g., device under test 102). System 106 performs a transform on the response signal. Based on the transform, system 106 reconstructs a time-domain signal that represents the distortion features, using the techniques described herein. System 106 performs an analytical operation using one or more values included in the reconstructed time-domain signal. There are various types of analytical operations, including, e.g., a root mean square (RMS) operation to determine a RMS value of at least a portion of the reconstructed time-domain signal, an operation to determine a peak value of at least a portion of the reconstructed time-domain signal, an operation to determine a crest factor of at least a portion of the reconstructed time-domain signal, an operation to determine a mean value of the reconstructed time-domain signal, an operation to determine a Fourier transform (e.g., a fast Fourier transform) of the reconstructed time-domain signal, an operation to determine an energy value of at least a portion of the reconstructed time-domain signal, an operation to determine a power value of at least a portion of the reconstructed time-domain signal, an operation to determine a peak value of at least a portion of the reconstructed time-domain signal, an operation to determine a duration of at least a portion of the reconstructed time-domain signal, and an operation to perform envelope analysis of at least a portion of the reconstructed time-domain signal.

Figure 2:
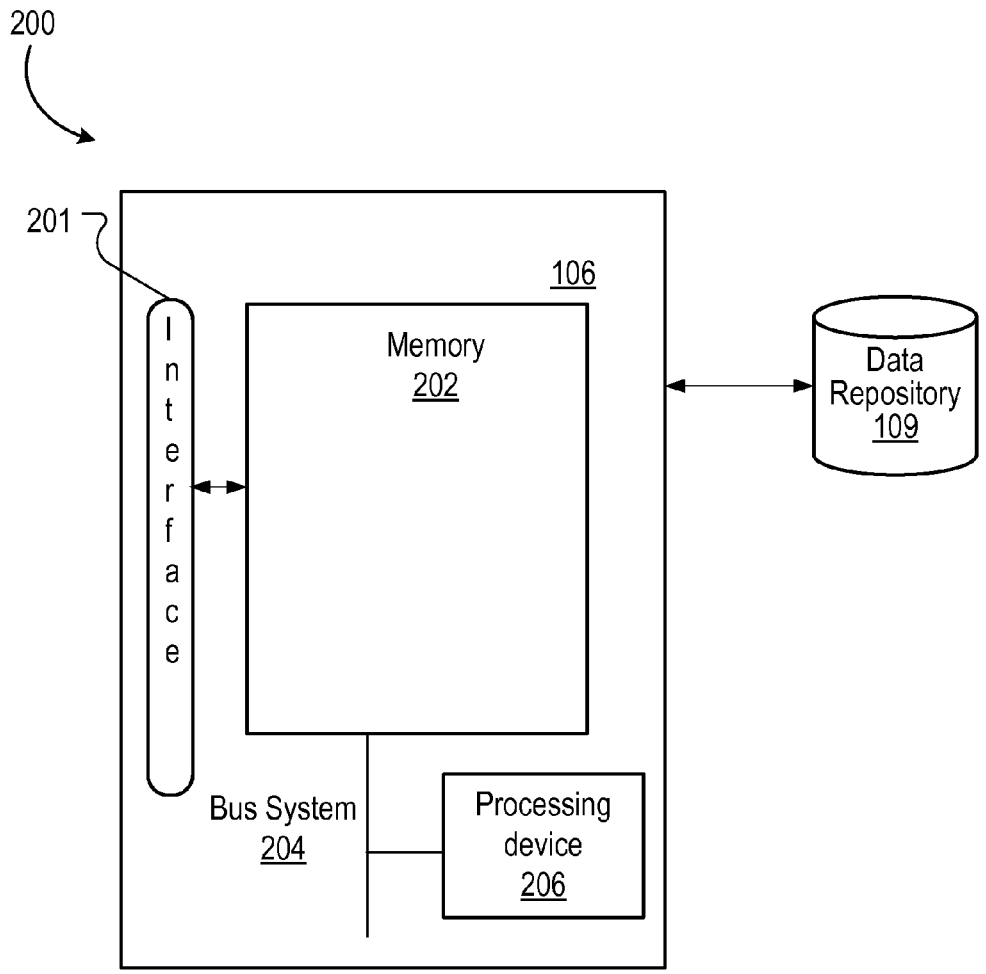
FIG. 2 is a block diagram of components of a system for testing transducers.

Referring to FIG. 2, components 200 of system 106 are shown. System 106 includes memory 202, a bus system 204, and processing device 206. Memory 202 can include a hard drive and a random access memory storage device, such as a dynamic random access memory, machine-readable media, machine-readable hardware storage devices, or other types of non-transitory machine-readable storage devices. A bus system 204, including, for example, a data bus and a motherboard, can be used to establish and to control data communication between the components of system 106. Processing device 206 may include one or more microprocessors and/or processing devices. Generally, processing device 206 may include any appropriate processor and/or logic that is capable of receiving and storing data, and of communicating over a network (not shown). For example, processing device 206 can include field-programmable gate array (FPGA)/application-specific integrated circuit (ASIC) or another form of dedicated high-speed digital hardware System 106 can be any of a variety of computing devices capable of receiving data, such as a server, a distributed computing system, a desktop computer, a laptop, a cell phone, a rack-mounted server, and so forth. System 106 may be a single server or a group of servers that are at a same location or at different locations. The illustrated system 106 can receive data from client devices (e.g., a device under test) via input/output ("I/O") interface 201. I/O interface 201 can be any type of interface capable of receiving data over a network, such as an Ethernet interface, a wireless networking interface, a fiber-optic networking interface, a modem, and so forth.

Figure 3:
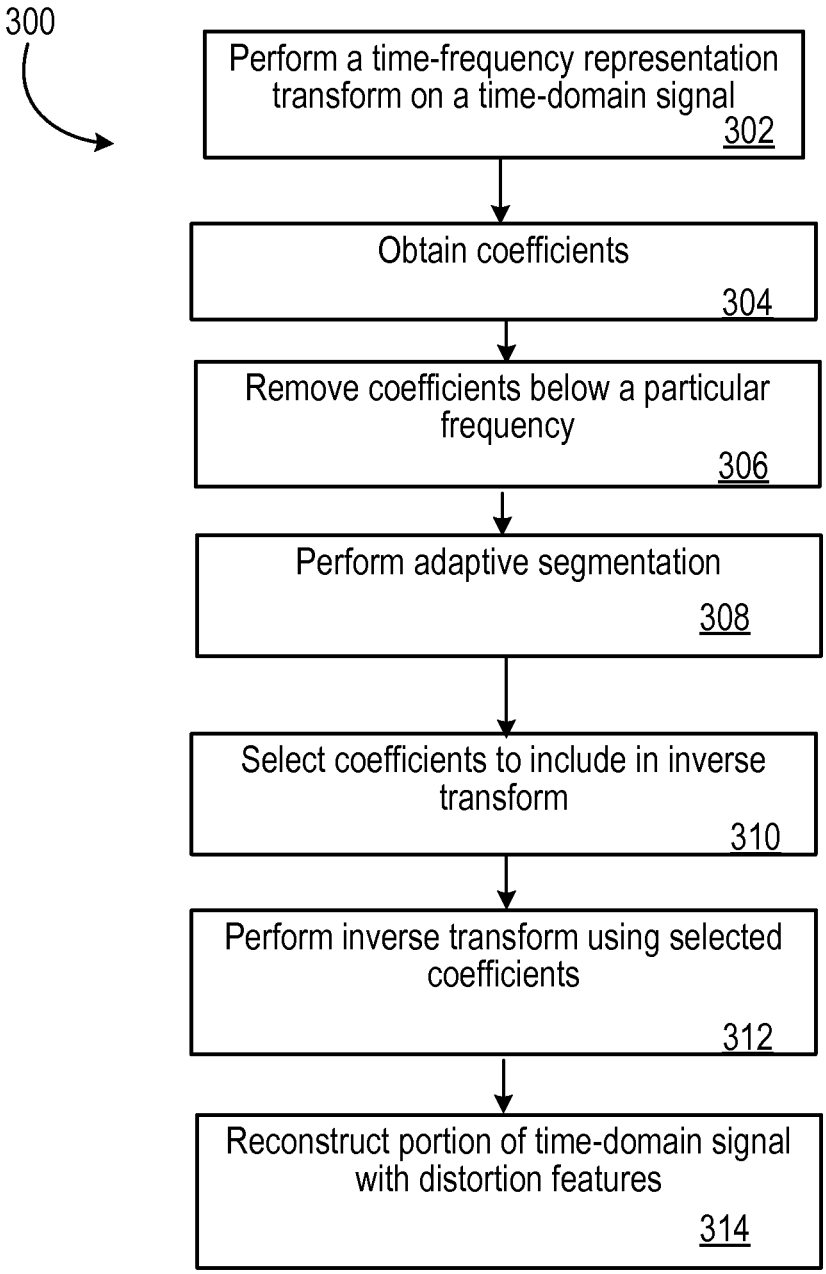
FIGS. 3 and 4 are flow charts of processes executed by a system for testing transducers.

Referring to FIG. 3, system 106 (FIG. 1) (and/or DWE engine 108 in FIG. 1) executes process 300 in extracting the distorted or transient features of a time-domain signal (e.g., device under test response to a stimulus). In operation, system 106 performs (302) a time-frequency representation transform on the time-domain signal. Based on the transform, system 106 obtains (304) coefficients for the time-domain signal. In an example, the time-frequency representation transform is a discrete wavelet transform (DWT). DWT includes a series of octave filters, in which an impulse response of the filter is selected to match predetermined features (e.g., features that are indicative of rub and buzz defects). Using DWT, system 106 may obtain a scaling function (e.g., low pass response) of the time-domain signal, a wavelet function (e.g., high-pass response) of the time-domain signal, and so forth.

The features that are indicative of distortions (e.g., transient oscillations) are associated with coefficients with frequency bands above a threshold frequency band. To remove coefficients that are unassociated with the transient oscillations (e.g., strong lower-order harmonic content), system 106 removes (306) coefficients below a particular frequency. For example, system 106 removes one or more of the obtained coefficients with one or more frequency bands below the threshold frequency band.

For the remaining coefficients, system 106 performs (308) adaptive segmentation in time to identify which of the remaining coefficients will be included in an inverse transform. Segmentation in time for a coefficient divides the coefficient into one or more portions indicative of an attribute of the coefficient. One type of attribute is a metric of statistical probability distribution, a combination of metrics of statistical probability distributions, or a Kurtosis value. Generally, Kurtosis is a measure of whether data are peaked or flat relative to a normal distribution. Kurtosis is indicative of a measure of peakedness and is therefore indicative of distortions. There are various manners in which system 106 performs adaptive segmentation in time, including, e.g., Kurtosis-based segmentation that is based on one or more sliding Kurtosis windows in time. In Kurtosis-based segmentation, system 106 determines a maximum Kurtosis value of a Kurtosis-based segmentation for each of the remaining coefficients. For maximum Kurtosis values of the remaining coefficients, system 106 also determines a ratio of (i) a highest maximum Kurtosis value of the remaining coefficients, to (ii) a lowest maximum Kurtosis value of the remaining coefficients.

System 106 selects (310) which of the remaining coefficients to use in an inverse transform. System 106 select one or more coefficients having attributes that are more indicative of the transient oscillations, relative to attributes of other of the coefficients. Generally, an attribute of a coefficient is a value, a quality or a characteristic of the coefficient itself or of another value derived from the coefficient, e.g., Kurtosis of the coefficient, values derived from Kurtosis of the coefficient, and so forth. In another example, an attribute represents a similarity of the model transient waveform to the transient oscillations in the time-domain signal. There are various manners in which system 106 selects which of the remaining coefficients to use in the inverse transform. In an example, system 106 selects a remaining coefficient when a maximum coefficient value (of the coefficient itself) exceeds a maximum coefficient threshold and the above-described ratio exceeds a ratio threshold (e.g., predefined value). In this example, there are various tunable parameters, e.g., the Kurtosis segmentation window length, a ratio threshold, a maximum coefficient threshold, a number of the remaining coefficients to select, and wavelet type to be used. In another example, system 106 selects one or more of the remaining coefficients by correlating a Kurtosis sliding window result against an expected model result for a particular stimulus frequency. The system 106 selects those coefficients associated with Kurtosis sliding window results with increased amounts of correlation to the expected model, relative to other amounts of correlation of other of the Kurtosis sliding window results to the expected model.

System 106 performs (312) an inverse transform on the selected coefficients. Based on performance of the inverse transform, system 106 reconstructs a portion of the time-domain signal that represents the transient oscillations. In an example, the time-domain signal is a device under test response to a stimulus. In this example, the stimulus is broken in single-frequency segments and actions 302, 304, 306, 308, 310, 312, 314 are performed for each segment.

Figure 4:
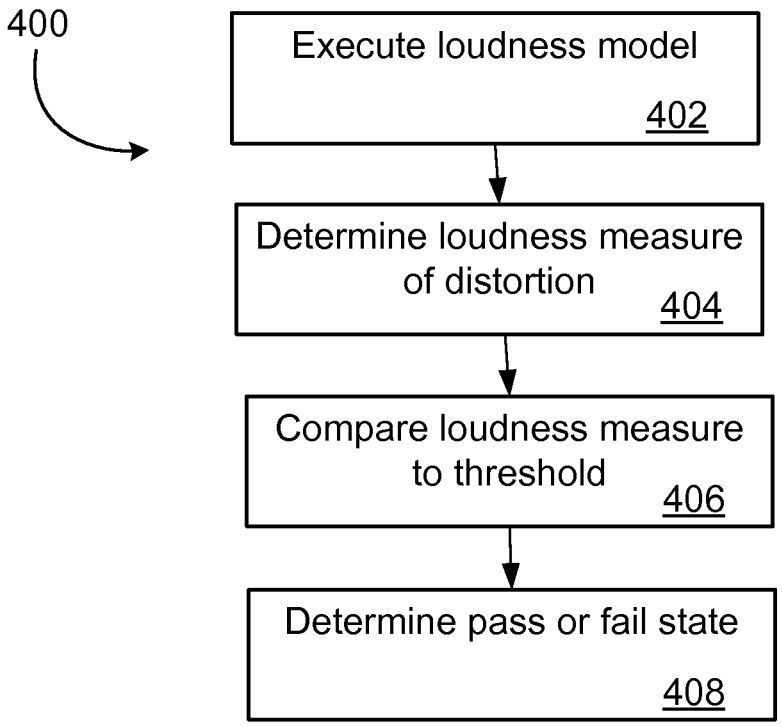

Referring to FIG. 4, system 106 implements process 400 in determining a loudness of a distortion (e.g., a rub and buzz defect). In operation, system 106 executes (402) a time-varying psychoacoustic loudness model against the extracted waveform distortion features. In some examples, prior to execution of the model, system 106 removes noise from the extracted waveform distortion features (e.g., using wavelet de-noising), to promote the audibility value being based primarily on the transient oscillations and not based on noise.

System 106 determines (404) a loudness measure of the distortion. For example, system 106 determines loudness of rub and buzz elements present in a response of a device under test to stimulus. System 106 compares (406) the loudness measure to a loudness threshold, e.g., a predefined loudness value. In this example, the loudness threshold is a user-configurable value. Based on the comparison, system 106 determines (408) whether the device under test is in a fail state or in a pass state. When the loudness measure is less than the threshold, the device under test is in a pass state, e.g., because the rub and buzz defect is at an acceptable level. When the loudness measure is greater than or equal to the threshold, the device under test is in a fail state, e.g., because the rub and buzz defect is at an unacceptable level.

There are various other types of time-varying psychoacoustic models, e.g., a time-varying timbre psychoacoustic model, a time-varying pitch psychoacoustic model, a time-varying psychoacoustic model for determining a quantitative measure, a time-varying psychoacoustic model for determining a qualitative measure, and so forth. Implementation of these various models provide various attributes (e.g., loudness, timbre, pitch, a quantitative measure, a qualitative measure and so forth) of distortion features of a response to a stimulus.

In a variation of FIG. 4, system 106 executes a time-varying psychoacoustic model (e.g., a time-varying timbre psychoacoustic model, a time-varying pitch psychoacoustic model, a time-varying psychoacoustic model for determining a quantitative measure, a time-varying psychoacoustic model for determining a qualitative measure, and so forth). Based on execution of the model, system 106 obtains a value indicative of an attribute (e.g., loudness, timbre, pitch, a quantitative measure, a qualitative measure and so forth) for at least a portion of the transient oscillations. System 106 compares the obtained value to a threshold value and determines, based on comparing, a pass state or a fail state for the device under test.

Figure 5:
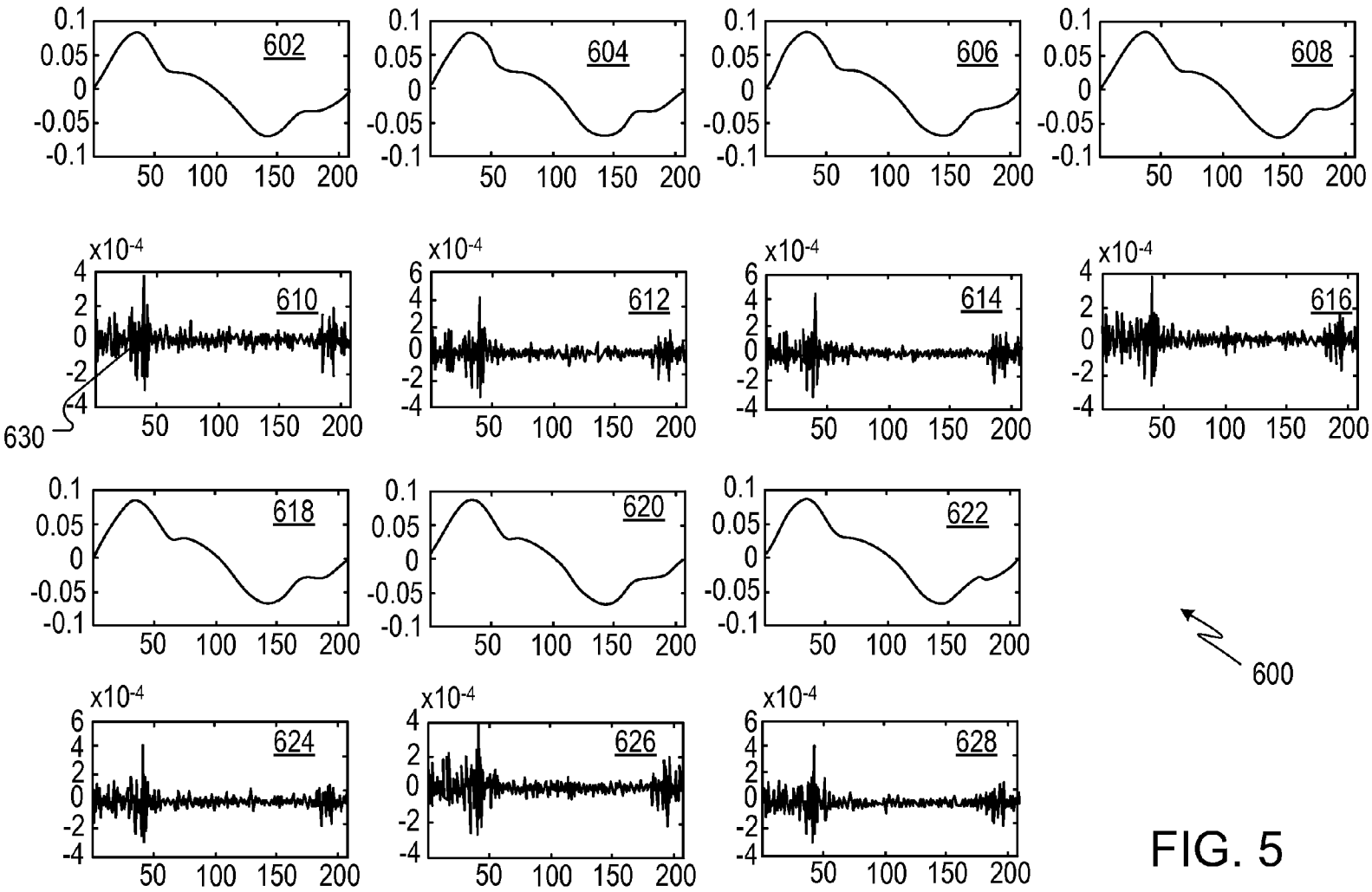
FIG. 5 is a diagram of a cycle-by-cycle visualization of segments of a stimulus and corresponding, extracted features.

Referring to FIG. 5, diagram 600 displays representations 602, 604, 606, 608, 618, 620, 622 of cycles (e.g., seven cycles) of a sinusoidal stimulus that is input into a device under test. For each of the cycles, diagram 600 also displays representations 610, 612, 614, 616, 624, 626, 628 (in time) of extracted waveform elements (e.g., rub and buzz waveform elements). Extracted waveform elements shown in representations 610, 612, 614, 616, 624, 626, 628 are produced by and correspond to cycles in time shown in representations 602, 604, 606, 608, 618, 620, 622, respectively. That is, diagram 600 provides a cycle-by-cycle visualization of extracted waveform elements (that are produced by system 106).

System 106 implements a cycle-by-cycle analysis to determine a type of defect that is causing the distortion. The cycle-by-cycle analysis uses the reconstructed time-domain signal (e.g., extracted waveform elements), with respect to cycles of the original stimulus waveform.

As shown in FIG. 5, a stimulus is transmitted to the device under test in a plurality of stimulus cycles (e.g., cycles shown in representations 602, 604, 606, 608, 618, 620 622). System 106 reconstructs, in the time-domain, the time-domain signal (e.g., extracts the distortion elements) for each of the cycles. The reconstructed time-domain signal for each of the stimulus cycles is shown in representations 610, 612, 614, 616, 624, 626, 628. The x-axis for each of representations 602-628 is a time domain. The y-axis for representations 602, 604, 606, 608, 618, 620, 622 is an amplitude of the sinusoidal input. The y-axis for representations 610, 612, 614, 616, 624, 626, 628 is a frequency of the extracted waveform features.

The reconstructed time-domain signal comprises portions, as shown in representations 610, 612, 614, 616, 624, 626, 628. That is, each of representations 610, 612, 614, 616, 624, 626, 628 displays a portion of the reconstructed signal. Each portion is associated with one of the stimulus cycles. For a particular stimulus cycle, system 106 identifies a time location, relative to the particular stimulus cycle, of features included in a portion of the reconstructed time-domain signal. System 106 does so by identifying a location in time of the features included in the portion of the reconstructed time-domain signal that is associated with the particular stimulus cycle. For example, representation 610 shows a first portion of the reconstructed waveform that is associated with the first cycle of the stimulus, as shown in representation 602. Representation 610 includes location in time 630 of distortion features. Location in time 610 is therefore associated with the first cycle of the input stimulus, as represented by representation 602.

System 106 determines a failure type of the device under test based on time locations, relative to the stimulus cycles, of the features in the reconstructed time-domain signal. System 106 may also determine a failure type based on time locations of stimulus cycles of same and/or different frequencies. For example, when the time locations, relative to the stimulus cycles, of the features are substantially the same among the stimulus cycles, the failure type includes voice coil rubbing resulting only from a misaligned voice coil in the device under test, voice coil bottoming in the device under test, and/or an air leak in the device under test. Wherein the time locations, relative to the stimulus cycles, of the features vary among the stimulus cycles of different frequencies, the failure type includes voice coil wire buzzing in the device under test, and/or voice coil rubbing resulting from uneven cone mass distribution in the device under test. When the time locations, relative to the stimulus cycles, of the features vary among the stimulus cycles of same and different frequencies and for different applications (e.g., applying the same stimulus to the device under test multiple times) of the same stimulus frequency, the failure type is audio distortions from a trapped foreign object in the device under test.

Using the techniques described herein, a system extracts the rub and buzz elements in a device under test response waveform, if present, and estimates the perceived loudness of those elements using a psychoacoustic model.

Embodiments can be implemented in digital electronic circuitry, or in computer hardware, firmware, software, or in combinations thereof. Apparatus to implement these techniques can be implemented in a computer program product tangibly embodied or stored in a machine-readable storage device for execution by a programmable processor; and method actions can be performed by a programmable processor executing a program of instructions to perform functions by operating on input data and generating output. The techniques described herein can be implemented advantageously in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object oriented programming language, or in assembly or machine language if desired; and in any case, the language can be a compiled or interpreted language.

Suitable processors include, by way of example, both general and special purpose microprocessors. Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD_ROM disks. Any of the foregoing can be supplemented by, or incorporated in, ASICs (application-specific integrated circuits).

Other embodiments are within the scope and spirit of the description claims. For example, due to the nature of software, functions described above can be implemented using software, hardware, firmware, hardwiring, or combinations of any of these. Features implementing functions may also be physically located at various positions, including being distributed such that portions of functions are implemented at different physical locations.

A number of embodiments of have been described. Nevertheless, it will be understood that various modifications may be made without departing from the spirit and scope of the techniques and system described herein.

What is claimed is:

1. A method for processing a time-domain signal with transient oscillations, the method comprising:

performing, by one or more computer systems, a time-frequency representation transform on the time-domain signal to obtain a plurality of coefficients, with a coefficient corresponding to a presence of an impulse response of a filter used by the time-frequency representation transform;

selecting one or more of the coefficients, with the selected one or more of the coefficients having attributes that are associated with the transient oscillations and excluding one or more of the coefficients having attributes that are unassociated with the transient oscillations; and reconstructing, based on performing an inverse transform on the selected one or more coefficients, a portion of the time-domain signal that represents the transient oscillations.

2. The method of claim 1, wherein the impulse response is represented by a model transient waveform.

3. The method of claim 2, wherein the attributes of the selected one or more coefficients represent a similarity of the model transient waveform to the transient oscillations in the time-domain signal.

4. The method of claim 1, wherein the time-frequency representation transform is a discrete wavelet transform.

5. The method of claim 1, wherein the transient oscillations are associated with coefficients with frequency bands above a threshold frequency band, and wherein selecting comprises:

removing one or more of the obtained coefficients with one or more frequency bands below the threshold frequency band to remove coefficients that are unassociated with the transient oscillations;

wherein selecting comprises selecting from remaining ones of the obtained coefficients.

6. The method of claim 1, further comprising:

performing segmentation in time on the remaining ones of the coefficients, with segmentation in time for a coefficient dividing the coefficient into one or more portions indicative of a characteristic of the coefficient.

7. The method of claim 6, wherein the segmentation is a Kurtosis-based segmentation that is based on one or more sliding Kurtosis windows in time, and wherein the method further comprises:

for a remaining coefficient, determining a maximum Kurtosis value of a Kurtosis-based segmentation for the remaining coefficient;

for maximum Kurtosis values of the remaining coefficients, determining a ratio of (i) a highest maximum Kurtosis value, to (ii) a lowest maximum Kurtosis value;

wherein selecting comprises selecting the coefficient, when the maximum coefficient value exceeds a maximum coefficient threshold and the ratio exceeds a ratio threshold.

8. The method of claim 6, wherein the segmentation is a Kurtosis-based segmentation that is based on one or more sliding Kurtosis windows, and wherein the method further comprises:

correlating a resulting Kurtosis sliding window result against an expected model result for a particular stimulus frequency;

wherein the selected one or more coefficients are based on correlations among the Kurtosis sliding window results and expected models.

9. A method for detecting transient oscillations in a response signal from a device under test, the method comprising:

performing a transform on the response signal;

reconstructing, by one or more computer systems, a time-domain signal that represents the transient oscillations of the response signal, with reconstruction being based on the transform;

executing a time-varying psychoacoustic model, with the reconstructed time-domain signal being an input to the time-varying psychoacoustic model;

obtaining, based on executing, a value indicative of an attribute for at least a portion of the transient oscillations;

comparing the obtained value to a threshold value; and determining, based on comparing, a pass state or a fail state for the device under test.

10. The method of claim 9, wherein the device under test is an acoustic transducer, and wherein the transient oscillations are indicative of rub and buzz distortions in the acoustic transducer, wherein a rub and buzz distortion comprises a non-linear sound distortion.

11. The method of claim 9, further comprising:

identifying a relative time location in the reconstructed time-domain signal in which specified features occur, based on a cycle-by-cycle analysis of the reconstructed time-domain signal, with respect cycles of an original stimulus waveform.

12. The method of claim 11, wherein the specified features comprise the transient oscillations or modulated noise.

13. The method of claim 9, wherein the transform provides a time-frequency representation of the time-domain signal.

14. The method of claim 9, wherein a stimulus is transmitted to the device under test in a plurality of stimulus cycles, wherein the transform provides a time-frequency representation of the time-domain signal, and wherein reconstructing comprises:

reconstructing, in the time-domain for the plurality of stimulus cycles, the time-domain signal, with reconstructing based on the time-frequency representation;

wherein the reconstructed time-domain signal comprises portions, with each portion associated with one of the stimulus cycles; and wherein the method further comprises:

for a particular stimulus cycle, identifying a time location, relative to the particular stimulus cycle, of features included in a portion of the reconstructed time-domain signal by identifying a location in time of the features included in the portion of the reconstructed time-domain signal that is associated with the particular stimulus cycle; and determining a failure type of the device under test based on time locations, relative to the stimulus cycles, of the features in the reconstructed time-domain signal.

15. The method of claim 14, wherein the time locations, relative to the stimulus cycles, of the features are substantially the same among the stimulus cycles, and wherein the failure type comprises one or more of:

voice coil rubbing resulting only from a misaligned voice coil in the device under test;

voice coil bottoming in the device under test; and an air leak in the device under test.

16. The method of claim 14, wherein the time locations, relative to the stimulus cycles, of the features vary among the stimulus cycles of different frequencies, and wherein the failure type comprises one or more of:

voice coil wire buzzing in the device under test; and voice coil rubbing resulting from uneven cone mass distribution in the device under test.

17. The method of claim 14, wherein the time locations, relative to the stimulus cycles, of the features vary among the stimulus cycles of same and different frequencies and for different applications of the same stimulus frequency, and wherein the failure type comprises: audio distortions from a trapped foreign object in the device under test.

18. The method of claim 9, further comprising:

removing noise from the reconstructed time-domain signal, prior to executing the time-varying psychoacoustic model, to promote the obtained value being based primarily on the transient oscillations and not based on noise.

19. The method of claim 9, further comprising:

measuring a magnitude and a phase of a voltage across and a current into the device under test, when a stimulus signal is fed to the device under test;

estimating a voice coil temperature in real time, at least partly based on the voltage across the device under test, the current into the device under test, a metal type of a voice coil in the device under test, an effective mass of the voice coil in the device under test, an amount of thermal resistance of the voice coil in the device under test, an amount of inductance of the voice coil in the device under test, and an amount of direct current resistance in the voice coil in the device under test;

determining, based on a measured sound pressure level in the device under test, a drop in sound pressure level relative to a sound pressure level in an absence of power compression;

adjusting, based on the determined drop, a voltage of a stimulus signal fed to the device under test to compensate for the power compression; and performing post-processing compensation of the measured sound pressure level for power compression in the device under test, based on at least one of the voice coil temperature the current into the device under test or the voltage across the device under test.

20. The method of claim 19, further comprising:

calculating speaker impedance of the device under test as a function of frequency, based on the measured current and voltage;

determining, based on calculating the speaker impedance, a resonance frequency of the device under test;

generating, based on the resonance frequency, the stimulus signal to have a frequency at the resonance frequency.

21. The method of claim 19, wherein the device under test is an acoustic transducer.

22. The method of claim 21, wherein the acoustic transducer comprises one of a device that is acoustic signal in and electrical signal out, a device that is electrical signal in and acoustic signal out, a microphone or a loudspeaker.

23. The method of claim 9, wherein the time-varying psychoacoustic model comprises one of the following:

a time-varying loudness psychoacoustic model, and the attribute is loudness;

a time-varying timbre psychoacoustic model, and the attribute is timbre;

a time-varying pitch psychoacoustic model, and the attribute is pitch;

a time-varying psychoacoustic model for determining a quantitative measure, and the attribute is the quantitative measure; or a time-varying psychoacoustic model for determining a qualitative measure, and the attribute is the qualitative measure.

24. A method for performing analytical analysis on distortion features in a response signal from a device under test, the method comprising:

performing a transform on the response signal;

reconstructing, by one or more computer systems, a time-domain signal that represents the distortion features of the response signal, with reconstruction being based on the transform; and performing an analytical operation using one or more values included in the reconstructed time-domain signal.

25. The method of claim 24, wherein the analytical operation comprises one or more of:

a root mean square (RMS) operation to determine a RMS value of at least a portion of the reconstructed time-domain signal;

an operation to determine a peak value of at least a portion of the reconstructed time-domain signal;

an operation to determine a crest factor of at least a portion of the reconstructed time-domain signal;

an operation to determine a mean value of the reconstructed time-domain signal;

an operation to determine a Fourier transform of the reconstructed time-domain signal;

an operation to determine an energy value of at least a portion of the reconstructed time-domain signal;

an operation to determine a power value of at least a portion of the reconstructed time-domain signal;

an operation to determine a peak value of at least a portion of the reconstructed time-domain signal;

an operation to determine a duration of at least a portion of the reconstructed time-domain signal; or an operation to perform envelope analysis of at least a portion of the reconstructed time-domain signal.

26. A system comprising:

one or more processing devices; and one or more machine-readable hardware storage devices storing instructions that are executable by the one or more processing devices to perform operations for processing a time-domain signal with transient oscillations, the operations comprising:

performing a time-frequency representation transform on the time-domain signal to obtain a plurality of coefficients, with a coefficient corresponding to a presence of an impulse response of a filter used by the time-frequency representation transform;

selecting one or more of the coefficients, with the selected one or more of the coefficients having attributes that are associated with the transient oscillations and excluding one or more of the coefficients having attributes that are unassociated with the transient oscillations; and reconstructing, based on performing an inverse transform on the selected one or more coefficients, a portion of the time-domain signal that represents the transient oscillations.

27. The system of claim 26, wherein the impulse response is represented by a model transient waveform.

28. The system of claim 27, wherein the attributes of the selected one or more coefficients represent a similarity of the model transient waveform to the transient oscillations in the time-domain signal.

29. One or more machine-readable hardware storage devices storing instructions that are executable by one or more processing devices to perform operations for processing a time-domain signal with transient oscillations, the operations comprising:

performing a time-frequency representation transform on the time-domain signal to obtain a plurality of coefficients, with a coefficient corresponding to a presence of an impulse response of a filter used by the time-frequency representation transform;

selecting one or more of the coefficients, with the selected one or more of the coefficients having attributes that are associated with the transient oscillations and excluding one or more of the coefficients having attributes that are unassociated with the transient oscillations; and reconstructing, based on performing an inverse transform on the selected one or more coefficients, a portion of the time-domain signal that represents the transient oscillations.

30. The one or more machine-readable hardware storage devices of claim 29, wherein the impulse response is represented by a model transient waveform.

31. The one or more machine-readable hardware storage devices of claim 30, wherein the attributes of the selected one or more coefficients represent a similarity of the model transient waveform to the transient oscillations in the time-domain signal.

32. A system comprising:

one or more processing devices; and one or more machine-readable hardware storage devices storing instructions that are executable by the one or more processing devices to perform operations for detecting transient oscillations in a response signal from a device under test, the operations comprising:

performing a transform on the response signal;

reconstructing, by one or more computer systems, a time-domain signal that represents the transient oscillations of the response signal, with reconstruction being based on the transform;

executing a time-varying psychoacoustic model, with the reconstructed time-domain signal being an input to the time-varying psychoacoustic model;

obtaining, based on executing, a value indicative of an attribute for at least a portion of the transient oscillations;

comparing the obtained value to a threshold value; and determining, based on comparing, a pass state or a fail state for the device under test.

33. The system of claim 32, wherein the operations further comprise:

identifying a relative time location in the reconstructed time-domain signal in which specified features occur, based on a cycle-by-cycle analysis of the reconstructed time-domain signal, with respect cycles of an original stimulus waveform.

34. One or more machine-readable hardware storage devices storing instructions that are executable by one or more processing devices to perform operations for detecting transient oscillations in a response signal from a device under test, the operations comprising:

performing a transform on the response signal;

reconstructing, by one or more computer systems, a time-domain signal that represents the transient oscillations of the response signal, with reconstruction being based on the transform;

executing a time-varying psychoacoustic model, with the reconstructed time-domain signal being an input to the time-varying psychoacoustic model;

obtaining, based on executing, a value indicative of an attribute for at least a portion of the transient oscillations;

comparing the obtained value to a threshold value; and determining, based on comparing, a pass state or a fail state for the device under test.

35. The one or more machine-readable hardware storage devices of claim 34, wherein the operations further comprise:

identifying a relative time location in the reconstructed time-domain signal in which specified features occur, based on a cycle-by-cycle analysis of the reconstructed time-domain signal, with respect cycles of an original stimulus waveform.

36. A system comprising:

one or more processing devices; and one or more machine-readable hardware storage devices storing instructions that are executable by the one or more processing devices to perform operations for performing analytical analysis on distortion features in a response signal from a device under test, the operations comprising:

performing a transform on the response signal;

reconstructing, by one or more computer systems, a time-domain signal that represents the distortion features of the response signal, with reconstruction being based on the transform; and performing an analytical operation using one or more values included in the reconstructed time-domain signal.

37. The system of claim 36, wherein the analytical operation comprises one or more of:

a root mean square (RMS) operation to determine a RMS value of at least a portion of the reconstructed time-domain signal;

an operation to determine a peak value of at least a portion of the reconstructed time-domain signal;

an operation to determine a crest factor of at least a portion of the reconstructed time-domain signal;

an operation to determine a mean value of the reconstructed time-domain signal;

an operation to determine a Fourier transform of the reconstructed time-domain signal;

an operation to determine an energy value of at least a portion of the reconstructed time-domain signal;

an operation to determine a power value of at least a portion of the reconstructed time-domain signal;

an operation to determine a peak value of at least a portion of the reconstructed time-domain signal;

an operation to determine a duration of at least a portion of the reconstructed time-domain signal; or an operation to perform envelope analysis of at least a portion of the reconstructed time-domain signal.

38. One or more machine-readable hardware storage devices storing instructions that are executable by one or more processing devices to perform operations for performing analytical analysis on distortion features in a response signal from a device under test, the operations comprising:

performing a transform on the response signal;

reconstructing, by one or more computer systems, a time-domain signal that represents the distortion features of the response signal, with reconstruction being based on the transform; and performing an analytical operation using one or more values included in the reconstructed time-domain signal.

39. The one or more machine-readable hardware storage devices of claim 38, wherein the analytical operation comprises one or more of:

a root mean square (RMS) operation to determine a RMS value of at least a portion of the reconstructed time-domain signal;

an operation to determine a peak value of at least a portion of the reconstructed time-domain signal;

an operation to determine a crest factor of at least a portion of the reconstructed time-domain signal;

an operation to determine a mean value of the reconstructed time-domain signal;

an operation to determine a Fourier transform of the reconstructed time-domain signal;

an operation to determine an energy value of at least a portion of the reconstructed time-domain signal;

an operation to determine a power value of at least a portion of the reconstructed time-domain signal;

an operation to determine a peak value of at least a portion of the reconstructed time-domain signal;

an operation to determine a duration of at least a portion of the reconstructed time-domain signal; or an operation to perform envelope analysis of at least a portion of the reconstructed time-domain signal.

* * * * *